US006223961B1

(12) United States Patent
Boguslavsky et al.

(10) Patent No.: US 6,223,961 B1
(45) Date of Patent: May 1, 2001

(54) APPARATUS FOR CLEAVING CRYSTALS

(75) Inventors: Dmitri Boguslavsky, Haifa; Colin Smith, Menashe; Arnon Ben-Nathan, Kiryat Tivon, all of (IL)

(73) Assignee: Sela Semiconductor Engineering, Yokneam (IL)

( * ) Notice: Subject to any disclaimer, the term of this patent is extended or adjusted under 35 U.S.C. 154(b) by 0 days.

(21) Appl. No.: 09/298,773

(22) Filed: Apr. 22, 1999

(30) Foreign Application Priority Data

Apr. 23, 1998 (IL) ..... 124199

(51) Int. Cl.[7] ..... B26F 3/00
(52) U.S. Cl. ..... 225/103; 225/96.5
(58) Field of Search ..... 225/96, 96.5, 103, 225/104

(56) References Cited

U.S. PATENT DOCUMENTS

| | | | | |
|---|---|---|---|---|
| 3,207,398 | * | 9/1965 | Forsstrom et al. | 225/103 |
| 3,680,213 | | 8/1972 | Reichert | 33/18 R |
| 3,998,201 | * | 12/1976 | Miura et al. | 225/103 |
| 4,228,937 | | 10/1980 | Tocci | 225/96.5 |
| 4,256,246 | * | 3/1981 | Kindel | 225/103 |
| 4,775,085 | | 10/1988 | Ishizuka et al. | 225/105 |
| 4,790,465 | * | 12/1988 | Fellows et al. | 225/96 |
| 4,837,915 | * | 6/1989 | Willms | 225/103 |
| 5,069,195 | * | 12/1991 | Barozzi | 225/96.5 |
| 5,740,953 | | 4/1998 | Smith et al. | 225/2 |

FOREIGN PATENT DOCUMENTS

WO 93/04497 3/1993 (WO) .

* cited by examiner

*Primary Examiner*—M. Rachuba
*Assistant Examiner*—Stephen Choi
(74) *Attorney, Agent, or Firm*—McDonnell Boehnen Hulbert & Berghoff

(57) ABSTRACT

Apparatus for cleaving a crystalline segment, including a pair of aligning pins facing a first cleave plane formed on a first side of a crystalline segment, an impact pin facing a second cleave plane formed on a second side of the crystalline segment opposite to the first side, the crystalline segment having a cleave line extending between and generally perpendicular to the opposing cleave planes, and an actuator connected to at least one of the aligning pins and the impact pin, for causing relative movement of the aligning pins and the impact pin towards each other, such that the aligning pins abut against the first cleave plane and the impact pin abuts against the second cleave plane.

7 Claims, 2 Drawing Sheets

APPARATUS FOR CLEAVING CRYSTALS

FIELD OF THE INVENTION

The present invention relates generally to methods and apparatus for cleaving crystals, and particularly to methods and apparatus for cleaving crystals in preparation for defect analysis, such as by scanning electron microscopy (SEM).

BACKGROUND OF INVENTION

Cleaving apparatus for cleaving crystals or wafers are known. For example, U.S. Pat. Nos. 3,680,213 to Reichert, 4,228,937 to Tocci, and 4,775,085 to Ishizuka et al. describe various apparatus suitable for breaking or cleaving semiconductor wafers or crystals. In particular, accurate cleaving of wafers is disclosed in PCT published patent application WO 93/04497, corresponding to U.S. patent application Ser. No. 08/193,188, assigned to the present applicant/assignee, the disclosures of which are incorporated herein by reference.

An important application of cleaving is in preparing wafers for scanning electron microscopy (SEM), which is one method used to analyze defects of semiconductor wafers. The apparatus and methods of PCT published patent application WO 93/04497 can be successfully used to prepare wafers for SEM (and even transmission electron microscopy—TEM), but are limited to a minimum size of wafer, this size being about 40×13 mm, in length and width. It is desirable to have a method and apparatus for cleaving smaller crystalline segments, such as semiconductor dice, which are not readily and accurately cleaved with prior art apparatus and techniques.

SUMMARY OF THE INVENTION

The present invention seeks to provide improved methods and apparatus for cleaving small crystalline segments, such as semiconductor dice or small segments which cannot be cleaved with prior art apparatus.

There is thus provided in accordance with a preferred embodiment of the present invention apparatus for cleaving a crystalline segment, including a pair of aligning pins facing a first cleave plane formed on a first side of a crystalline segment, an impact pin facing a second cleave plane formed on a second side of the crystalline segment opposite to the first side, the crystalline segment having a cleave line extend between and generally perpendicular to the opposing leave planes, and an actuator connected to at least one of the aligning pins and the impact pin, for causing relative movement of the aligning pins and the impact pin towards each other, such that the aligning pins abut against the first cleave plane and the impact pin abuts against the second cleave plane.

In accordance with a preferred embodiment of the present invention the impact pin is aligned with the crystalline segment such that an imaginary line extending from the cleave line towards the impact pin substantially intersects a center of the impact pin.

Further in accordance with a preferred embodiment of the present invention the aligning pins are arranged generally symmetrically on opposite sides of the cleave line.

Still further in accordance with a preferred embodiment of the present invention the impact pin is connected to the actuator and the aligning pins are stationary.

In accordance with another preferred embodiment of the present invention the aligning pins are mechanically linked to a knife by means of linkage arms, the knife being movable by the actuator to impact the first cleave plane. Preferably, in such an embodiment, the impact pin is stationary.

Further in accordance with a preferred embodiment of the present invention the linkage arms permit moving the aligning pins and the knife together, but also permit moving the knife independently of the aligning pins.

Still further in accordance with a preferred embodiment of the present invention the aligning pins apply a preload to the crystalline segment.

BRIEF DESCRIPTION OF THE DRAWINGS

The present invention will be understood and appreciated more fully from the following detailed description, taken in conjunction with the drawings in which:

FIGS. 1A–1D are simplified illustrations of a method and apparatus for cleaving a crystalline segment in accordance with a preferred embodiment of the present invention, particular useful for coarse cleaving, wherein:

FIG. 1A is a simplified illustration of a crystalline segment placed in a coarse cleaving apparatus;

FIG. 1B is a simplified illustration of aligning and preloading the crystalline segment;

FIG. 1C a simplified illustration of a knife of the cleaving apparatus impacting the crystalline segment; and FIG. 1D is a simplified illustration of cleaving the crystalline segment; and FIGS. 2A–2C are a simplified illustrations of a method and apparatus for cleaving a crystalline segment in accordance with another preferred embodiment of the present invention, particular useful for fine cleaving, wherein:

FIG. 2A is a simplified illustration of a crystalline segment placed in a fine cleaving apparatus;

FIG. 2B is a simplified illustration of a striking pin of the cleaving apparatus impacting the crystalline segment; and FIG. 2C is a simplified illustration of cleaving the crystalline segment.

DETAILED DESCRIPTION OF A PREFERRED EMBODIMENT

Figure 1A:
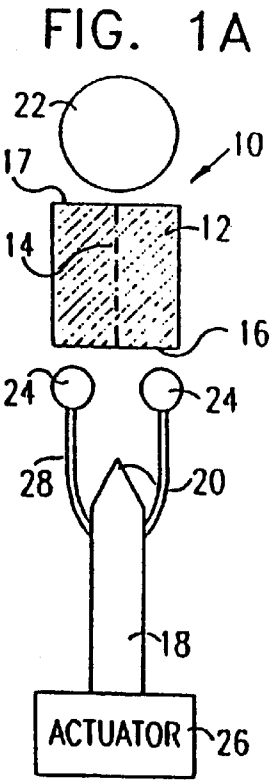

Reference is now made to FIGS. 1A–1D which illustrate a method and apparatus for cleaving a crystalline segment in accordance with a preferred embodiment of the present invention. The apparatus illustrated in FIGS. 1A–1D, referred to as cleaving apparatus 10, is particular useful for coarse cleaving a crystalline segment 12 along a cleave line 14. As is well known in the art, cleave line 14 is defined by the particular crystalline structure. Crystalline segment 12 preferably has a monocrystal structure, such as a cubic or pyramid structure, for example. Cleave line 14 is preferably substantially perpendicular to a pair of first and second cleave planes 16 and 17. Cleave planes 16 and 17 are preferably substantially parallel to each other.

Apparatus 10 includes a cleaving knife 18 which preferably has a wedge-like tip 20. An impact pin 22 supports segment 12 during cleaving, and is preferably aligned with knife tip 20 such that an imaginary line extending from the center of pin 22 to tip 20 is substantially aligned with cleave line 14. In other words, an imaginary line extending from the center of pin 22 to tip 20 is substantially parallel to internal faces of the crystalline structure of segment 12, along which faces cleaving can be accomplished.

A pair of aligning pins 24 are preferably symmetrically positioned on opposite sides of cleave line 14. Pins 22 and 24 may be constructed of a suitably hard material, such as steel. Knife 18 is preferably coupled to an actuator 26. Actuator 26 may be a step motor or linear actuator, for example, which moves knife 18 towards/away from crystalline segment 12 either incrementally or continuously. Pins 24 are preferably mechanically linked to knife 18 by means of linkage arms 28 which allow moving pins 24 and knife 18 together, but which also permit knife 18 to move linearly independently of pins 24, as will be described further hereinbelow.

Figure 1B:
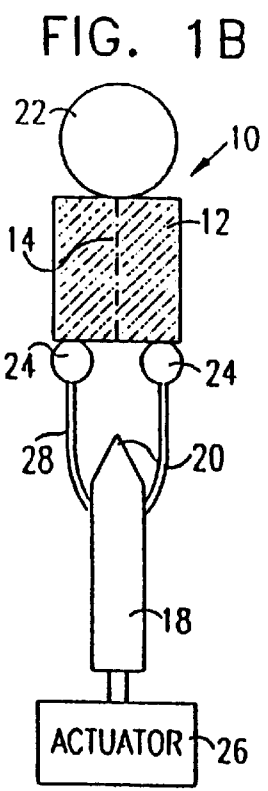

The steps of the cleaving process in accordance with a preferred embodiment of the present invention are now described with reference to FIGS. 1A–1D. In FIG. 1A, crystalline segment 12 is placed between impact pin 22 and aligning pins 24. In FIG. 1B, actuator 26 moves knife 18 and aligning pins 24 together until aligning pins 24 abut against cleave plane 16 and pin 22 abuts against cleave plane 17, thereby sandwiching segment 12 between pins 24 and pin 22. This ensures that an imaginary line extending from the center of pin 22 to tip 20 is substantially aligned with cleave line 14. In addition, pins 24 not only abut against cleave plane 16, but also apply a preload to crystalline segment 12. The preload may be in the range of 1–50 grams, typically 20 grams, for example.

Figure 1C:
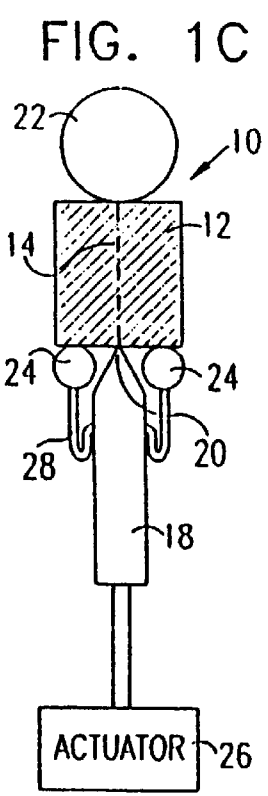
Figure 1D:
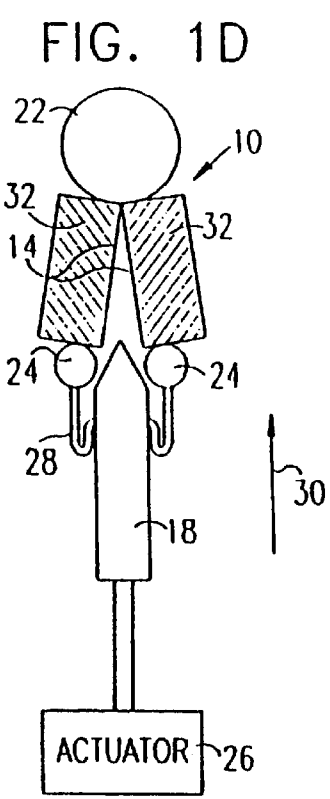

In FIG. 1C, actuator 26 further advances knife 18 until knife 18 impacts cleave plane 16. It is seen that aligning pins 24 remain against cleave plane 16, and that linkage arms 28 flex, bend or otherwise deform to permit knife 18 to move linearly independently of pins 24. Accordingly, linkage arms 28 may be springs, flexible arms, jointed arms or articulated arms, for example. Upon impacting cleave plane 16, knife 18 causes cleaving of crystalline segment 12 along cleave line 14 into two segments 32, as seen in FIG. 1D. As is known in the art, knife tip 20 may slightly enter segment 12 at the initiation of the cleaving.

Figure 2A:
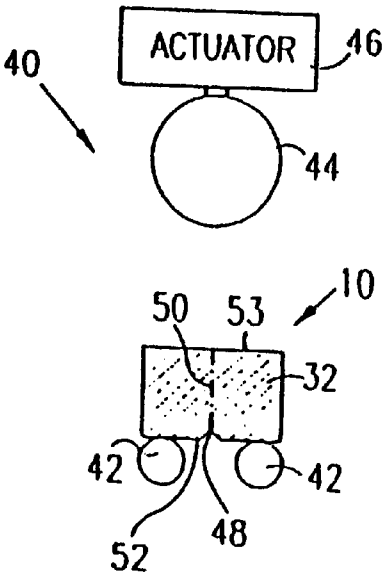
Figure 2B:
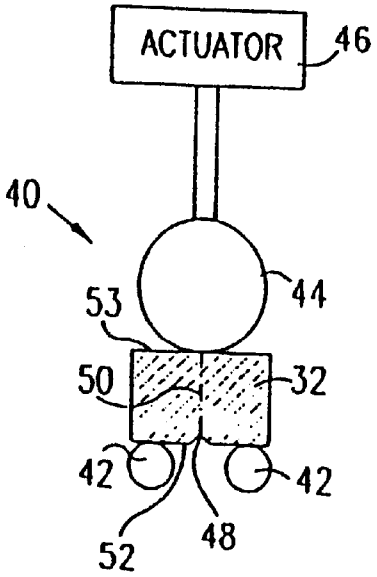
Figure 2C:
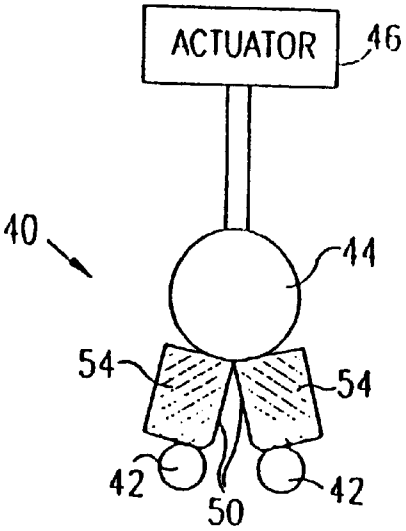

The present invention also provides fine cleaving apparatus, particularly useful for fine cleaving segments such as segments 32 produced after coarse cleaving with apparatus 10. Reference is now made to FIGS. 2A–2C which illustrate apparatus 40 for cleaving a crystalline segment, such as segment 32, in accordance with another preferred embodiment of the present invention.

Cleaving apparatus 40 includes two aligning pins 42 which are stationary, unlike aligning pins 24 of apparatus 10. Otherwise, aligning pins 42 are preferably generally identical to aligning pins 24. An impact pin 44 is provided for striking the segment 32. An actuator 46, preferably similar to actuator 26, is connected to impact pin 44 for advancing impact pin 44 towards segment 32.

The steps of the cleaving process in accordance with a preferred embodiment of the present invention are now described with reference to FIGS. 2A–2C. In FIG. 2A, crystalline segment 32 is placed between stationary aligning pins 42 and impact pin 44. Prior to this placement, segment 32 is preferably prepared with a notch 48 formed at a cleave line 50 in segment 32. Notch 48 may be formed using the methods and apparatus of PCT published patent application WO 93/04497, corresponding to U.S. patent application Ser. No. 08/193,188. Segment 32 is preferably aligned with impact pin 44 such that an imaginary line extending from the center of pin 44 to notch 48 is substantially aligned with cleave line 50. Cleave line 50 is preferably substantially perpendicular to a cleave plane 52.

In FIG. 2B, actuator 46 advances impact pin 44 towards segment 32 such that pin 44 impacts cleave plane 53. Upon impacting cleave plane 53, impact pin 44 causes cleaving of segment 32 along cleave line 50 into two new segments 54, as seen in FIG. 2C. Segments 54 may be inspected for defects using SEM, for example.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. Apparatus for cleaving a crystalline segment, comprising:

a knife facing a first cleave plane formed on a first side of a crystalline segment, said crystalline segment having a cleave line extending between and generally perpendicular to said opposing cleave planes;

an impact pin facing a second cleave plane formed on a second side of said crystalline segment opposite to said first side, said impact pin and said knife being aligned on opposite sides of said cleave line; and an actuator connected to said knife and said impact pin, for causing relative movement of said knife and said impact pin towards each other, such that said knife abuts against said first cleave plane and said impact pin abuts against said second cleave plane, and said knife cleaves said crystalline segment generally along said cleave line.

2. Apparatus according to claim 1 and further comprising a pair of aligning pins facing said first cleave plane, wherein said aligning pins are arranged generally symmetrically on opposite sides of said cleave line.

3. Apparatus according to claim 2 wherein said impact pin is connected to said actuator and said aligning pins are stationary.

4. Apparatus according to claim 2 wherein said aligning pins are mechanically linked to said knife by means of linkage arms.

5. Apparatus according to claim 4 wherein said impact pin is stationary.

6. Apparatus according to claim 4 wherein said linkage arms permit moving said aligning pins and said knife together, but also permit moving said knife independently of said aligning pins.

7. Apparatus according to claim 4 wherein said aligning pins apply a preload to said crystalline segment.

* * * * *